United States Patent [19]

Daley

[11] Patent Number: 4,550,911

[45] Date of Patent: Nov. 5, 1985

[54] SCOOT BALL GAME APPARATUS

[76] Inventor: James A. Daley, 121½ N. Wabash, Glendora, Calif. 91740

[21] Appl. No.: 527,239

[22] Filed: Aug. 29, 1983

[51] Int. Cl.[4] ..... A63F 7/06; A63F 7/30

[52] U.S. Cl. ..... 273/94; 273/387; 273/390

[58] Field of Search ..... 273/94, 126, 128 R, 273/387, 390

[56] References Cited

U.S. PATENT DOCUMENTS

| | | | |
|---|---|---|---|
| 336,179 | 2/1886 | Vogelsang | 273/126 R |
| 489,853 | 1/1893 | Davids | 273/126 R |
| 1,080,299 | 12/1913 | Richmond | 273/390 X |
| 1,532,385 | 4/1925 | Cox | 273/94 R |
| 1,562,866 | 11/1925 | Burgess | 273/94 R |
| 1,680,356 | 8/1928 | Yaraus | 273/94 R |
| 2,350,031 | 5/1944 | Hagan | 273/94 R |
| 2,600,940 | 6/1952 | Tullio | 273/94 R X |
| 2,801,853 | 8/1957 | Lombardo et al. | 273/94 |
| 3,467,386 | 9/1969 | Smith | 273/126 R |
| 3,825,264 | 7/1974 | Dockum | 273/126 R |

*Primary Examiner*—Paul E. Shapiro

*Attorney, Agent, or Firm*—Boniard I. Brown

[57] ABSTRACT

A game apparatus including a playing board with a surface thereon for manually gliding a slideable indicator thereover. The indicator has indicium at one end thereof which is used in conjunction with markings on the playing board to determine relative gains and losses between two players, a sufficient gain by one player resulting in a goal. The apparatus also includes a goal post structure with an overcenter mounted, elevated grid panel. After a player attains a predetermined position on the game board, the indicator is manually flicked into the air to strike the grid panel. Movement of the panel indicates a successful scoring attempt.

19 Claims, 7 Drawing Figures

FIG-1
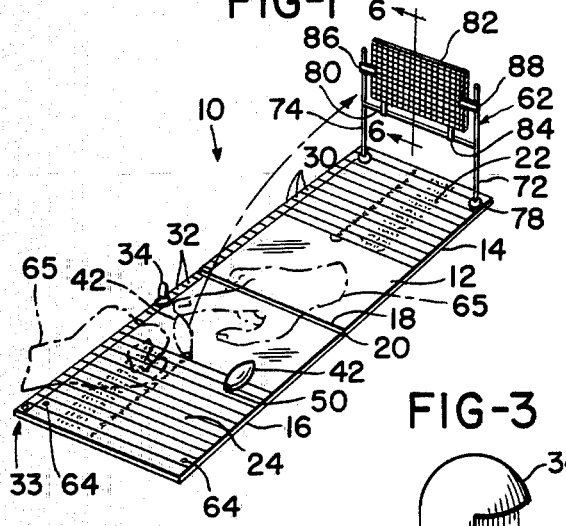
FIG-2
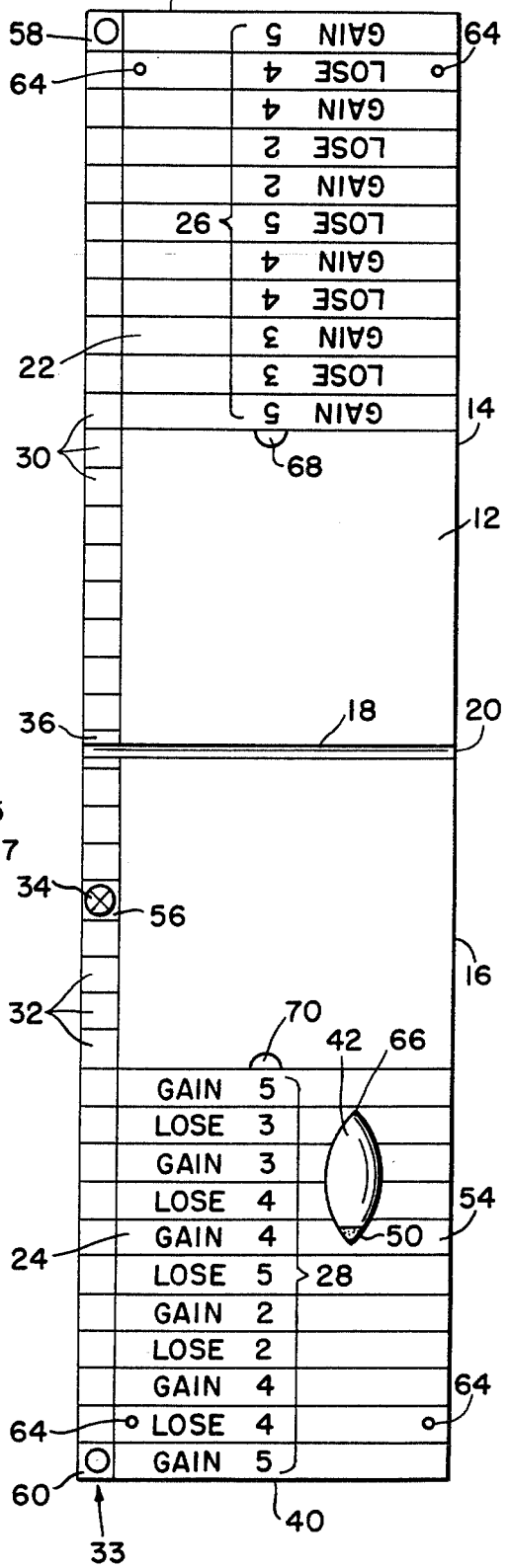
FIG-3
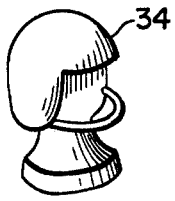
FIG-4
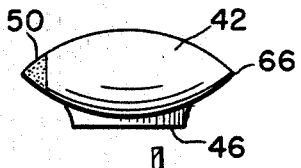
FIG-5
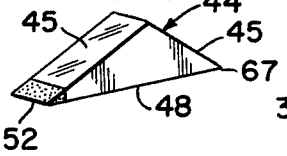
FIG-6
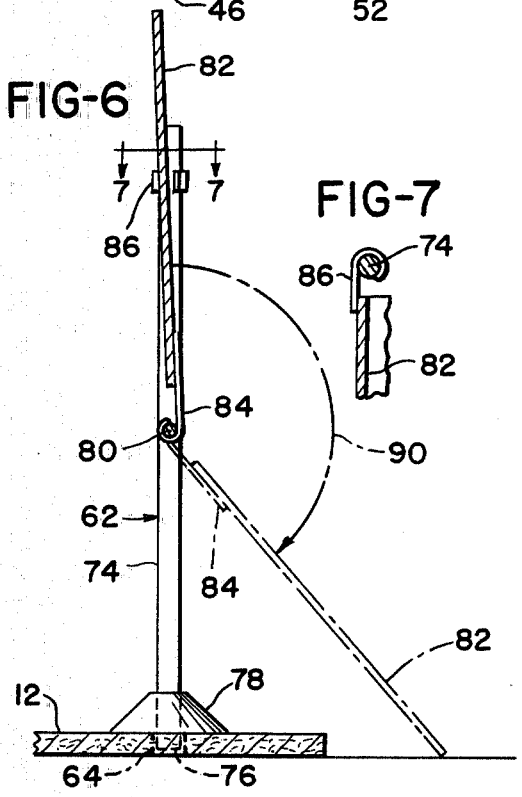
FIG-7

SCOOT BALL GAME APPARATUS

BACKGROUND OF THE INVENTION

Various games, such as shuffleboard, require application of a player's skill in determining the relative effects of inertia and friction to place a sliding puck at a predetermined location. Most of such game apparatus require either a fixed court or an extremely large non-portable table which restricts the play of such inertia/friction games to fixed locations and therefore are not portable or useful in play during unexpected leasure.

BRIEF DESCRIPTION OF THE PRESENT INVENTION

The present invention includes a foldable play board having a slide surface thereon which is used along with a specially shaped slider member or puck having indicium in the form of a pointer on one end thereof so that when the member is slid on the surface, the pointer overlays markings on the slide surface to indicate the relative success or failure of the player putting the member in motion. The invention allows one or more players to exercise their judgement as to the interrelationships between inertia and friction to pass the time in a pleasant diversion. A scale and marker therefor are provided on the board to keep track of the efforts of the players and to help determine when one player has scored. A goal is provided with a panel mounted in an overcenter fashion so that when struck, the panel moves to a new location to indicate additional scoring. This scoring can be accomplished by flicking the slider member into an aerial path where it strikes the panel. The goal is usually shaped like the goal post of American football while the marker may be shaped to suggest the helmeted head of a football player. In some cases, the slider member may be shaped generally like the shape of an American football.

It is therefore an object of the present invention to provide a tabletop game for use by one or more players which requires manual dexterity for excellence of play.

Another object is to provide a shuffleboard-like tabletop game whose components can be stored in a relatively small volume.

Another object is to provide a manual dexterity game which is difficult enough to present a challenge and yet has random elements which allow a less skilled player to compete in an entertaining manner.

These and other objects and advantages of the present invention will become apparent to those skilled in the art after considering the following detailed specification together with the accompanying drawing, wherein:

BRIEF DESCRIPTION OF THE DRAWING

FIG. 1 is a perspective view of the game apparatus of the present invention assembled for play;

FIG. 2 is an enlarged top view of the game board of FIG. 1 showing the marking thereof;

FIG. 3 is an enlarged detailed view of a score marker for the game apparatus of FIG. 1;

FIG. 4 is an enlarged detailed view of a football-shaped slider member for use with the apparatus of FIG. 1;

FIG. 5 is an alternate embodiment of the slider member shown in FIG. 4;

FIG. 6 is an enlarged cross-sectional view showing the details of the goal indicating goal post of the present invention taken at line 6—6 of FIG. 1; and FIG. 7 is detailed cross-sectional view taken at line 7—7 of FIG. 6.

DETAILED DESCRIPTION OF THE SHOWN EMBODIMENT

Referring to the drawing more particularly by reference numbers, number 10 in FIG. 1 refers to a game apparatus constructed according to the present invention. The apparatus 10 includes a game board 12 constructed generally from two essentially two board pieces 14 and 16 connected at the midpoint 18 by a suitable hinge 20 which may be simply made from paper or cloth. The hinge 20 allows the pieces 14 and 16 to be folded for compact storage. When opened, as shown in FIG. 1, a playing surface 22 and 24 on each of the pieces 14 and 16 respectively is exposed for play. As shown in FIG. 2, the surfaces 22 and 24 include skill measuring, crosswise bands of indicia 26 and 28 which are essentially identical. The indicia 26 and 28 indicate the numeric losses and gains of the players. Progress indica 30 and 32 are provided along one side of the board 12 to form a scale 33 on which a marker 34 can be moved to keep track of the losses and gains. As shown, the marker 34 may be sculptured to simulate the helmeted head of a player of American football.

Normally when two players start to play a game utilizing the apparatus 10, the marker 34, shown in FIG. 3, is placed on the centrally located progress indicia space 36, the players then position themselves at the opposite ends 38 and 40 of the game board 12. One player then accelerates a slider member, such as the football shaped member 42 or the pyramid shaped member 44 having a pair of obtuse angled, isoceles triangle sides 45 shown respectively in FIGS. 4 and 5, on the adjacent playing surface 22 or 24 over the skill indicia 28 or 26 positioned thereon. The playing surfaces 22 and 24 have a predetermined coefficient to friction with respect to a moulded slider surface 46 on the member 42 or the base slider surface 48 on the member 44. Once given an initial velocity, the member 42 or 44 is propelled by its own inertia and decelerated by the friction between its slider surface and the game board 12. The player tries to match the friction and inertia so that the member 42 or 44 comes to rest with its pointer 50 or 52 over a skill indicia band 54 on the opposite game board piece marked "GAIN". The pointer 50 or 52 usually is distinguished from the rest of the member 42 or 44 by its color or texture and it is sized smaller than a band so that is easy to determine which band it overshadows to indicate how many spaces the marker 34 should be advanced or retreated on the scale 33.

For example, in FIG. 2, a player at end 38 has slid the marker 42 so that the pointer 50 thereof overshadows a band 54 indicating a gain of four. If that were the first play of the game, the marker 34 would then be moved from the space 36 to the space 56 for a net gain of four along the scale 33. The players alternate sliding the member 42 until the marker 34 has been moved to one or the other of the end spaces 58 or 60 indicative of a goal. This gives the player at the opposite end 40 or 38 one point and to also indicates the end of one of four play periods required to complete the game. The player who scored then has an opportunity to make a field goal. This is accomplished by erecting a goal post 62 in goal post mounting holes 64 at the opposite end 38 or 40. The player, whose hands 65 are shown in FIG. 1, then stands the slider member 42 or 44 upright with its pointer end 50 or 52 or its opposite end 66 or 67 on the adjacent goal kick indicia 68 or 70 located on the board 12 and flicks it in an aerial path toward the goal post 62.

The goal post 62 includes two uprights 72 and 74 whose lower ends 76 are sized to be positioned within the holes 64 for erection thereof. Frustroconical supports 78 are provided on the uprights 72 and 74 adjacent the ends 76 to assure the uprights 72 and 74 are retained in a vertical position. A cross bar 80 extends between the two uprights 72 and 74 and, as shown in FIG. 6, provides a hinge line for a score indicating grid panel 82 which is mounted thereto by suitable hooks 84. When erected for a goal try the grid panel 82 is supported overcenter toward the player attempting the goal by stops 86 and 88 which extend sidewardly toward each other from the uprights 72 and 74 above the cross bar 80. When the member 42 or 44 is flipped properly, it strikes the grid panel 82 causing it to rotate in the direction of arrow 90 to the down position shown in dashed outline in FIG. 6 indicating that a flicked field goal has been scored. Usually, three points are attributed to this maneuver for the successful player.

Players may also gain the right to attempt a flicked goal by sliding the slider member 42 or 44 so that the pointer 50 or 52 thereof extends beyond the ends 38 or 40 with the member 42 or 44 resting on the game board 12. Thus extremely skillful players can amass a large number of points before the four playing periods of the game are complete.

Therefore there has been shown and described a novel game apparatus which fulfills all the objects and advantages sought therefore. Many changes, modifications, variations and other uses and applications of the subject invention will, however, become apparent to those skilled in the art after considering the foregoing specification together with the accompanying drawing. All such changes, modifications, variations and other uses and applications which do not depart from the spirit and scope of the invention are deemed to be covered by the invention which is limited only by the claims which follow:

What is claimed is:

1. A game apparatus including:

a playing board having a longitudinal direction and first and second ends, and having:

a surface with predetermined frictional characteristics, a plurality of bands extending transversely of the playing board and including:

first gain indicating bands, and first loss indicating bands, said first gain indicating bands said first loss indicating bands being nested adjacent said first end, second gain indicating bands, and second loss indicating bands, said second gain indicating bands and said second loss indicating bands being nested adjacent said second end, a slider member having:

a first end defining a pointer, a slider surface adapted to slide on said surface of said playing board with predetermined frictional characteristics, and goal post structure positioned at the playing board and including first and second uprights in spaced relation and a crossbar interconnecting the first and second uprights.

2. The game apparatus as defined in claim 1 wherein said slider member is shaped generally like an American football.

3. The game apparatus as defined in claim 1 wherein said slider member is a pyramid with a pair of obtuse angled, isoceles triangle sides, said slider surface being the base of the pyramid.

4. The game apparatus as defined in claim 1 wherein said playing board further includes:

first and second sides extending from said first end to said second end;

a scale extending from said first end to said second end along said first side, said scale including:

an odd number of spaces, said apparatus further including a marker member sized to be used in association with said odd number of spaces to indicate on said scale the accumulation of losses and gains of players using said apparatus.

5. A game apparatus according to claim 1, and further including:

means to removably support the first and second uprights at the playing board.

6. A game apparatus according to claim 1, wherein:

said pointer is of smaller size than the extension in said longitudinal direction of each of said bands to positively indicate a band which the pointer overlies to register a gain or loss.

7. A game apparatus including:

a playing board having a longitudinal direction and first and second side edges, and having:

a surface with predetermined frictional characteristics, a plurality of gain and loss bands defined thereon and including:

first gain indicating bands, first loss indicating bands, said first gain indicating bands and said first loss indicating bands being nested adjacent said first end, second gain indicating bands, second loss indicating bands, said second gain indicating bands and said second loss indicating bands being nested adjacent said second end, a slider member having:

a first end defining a pointer, a second end opposite said first end, and a slider surface adapted to slide on said surface of said playing board with predetermined frictional characteristics, goal post structure having:

first and second uprights with inwardly extending stops thereon, a crossbar connected to said first and second uprights, and a panel hingedly mounted to said crossbar and adapted to two stable positions, the first in contact with said stops generally between said first and second uprights above said crossbar and a second below said crossbar, and means to removably support said first and second uprights of said goal post structure on the playing board.

8. The game apparatus as defined in claim 7 wherein said means to removably support said first and second uprights of said goal post structure to said playing board include:

a first pair of passages adjacent said first end; and a second pair of passages adjacent said second end.

9. The game apparatus as defined in claim 7 wherein said playing board further includes:

a first slider member placement indicator adjacent said nested first gain and loss indicating bands spaced from said first end; and a second slider member placement indicator adjacent said nested second gain and loss indicating bands spaced from said second end.

10. A game apparatus including:

a playing board having a longitudinal direction and first and second side edges, and having:

a surface with predetermined frictional characteristics, a plurality of bands extending transversely of the playing board and including:

first gain indicating bands, first loss indicating bands, said first gain indicating bands and said first loss indicating bands being nested adjacent said first end, second gain indicating bands, second loss indicating bands, said second gain indicating bands and said second loss indicating bands being nested adjacent said second end, a slider member having:

a first end defining a pointer, a second end opposite said first end, a slider surface adapted to slide on said surface of said playing board with predetermined frictional characteristics, said pointer defined on the slider member being smaller in size than the widths of the respective bands to provide positive indication of which band the pointer overlies to register a gain or loss, a scale extending from said first end to said second end along said first side edge, said scale including:

an odd number of spaces, said apparatus further including a marker member sized to be used in association with said odd number of spaces to indicate on said scale the accumulation of losses and gains of players using said apparatus, and goal post structure having:

first and second uprights with inwardly extending stops thereon, a crossbar connected to said first and second uprights, and a panel hingedly mounted to said crossbar and adapted to two stable positions, the first in contact with said stops generally between said first and second uprights above said crossbar and a second below said crossbar, and means to removably support said first and second uprights of said goal post structure on the playing board.

11. The game apparatus as defined in claim 10 wherein said means to removably support said first and second uprights of said goal post structure to said playing board include:

a first pair of passages adjacent said first end; and a second pair of passages adjacent said second end.

12. The game apparatus as defined in claim 10 wherein said slider member is shaped generally like an American football.

13. The game apparatus as defined in claim 12 wherein said slider member first end defining a pointer is a different color than said second end.

14. The game apparatus as defined in claim 12 wherein said slider member first end defining a pointer has a different texture than said second end.

15. The game apparatus as defined in claim 10 wherein said slider member is a pyramid with a pair of obtuse angled, isoceles triangle sides, said slider surface being the base of the pyramid.

16. The game apparatus as defined in claim 15 wherein said slider member first end defining a pointer is a different color than said second end.

17. The game apparatus as defined in claim 15 wherein said slider member first end defining a pointer has a different texture than said second end.

18. The game apparatus as defined in claim 10 wherein said playing board includes:

a first planar piece having an end which is said first end of said playing board;

a second planar piece having an end which is said second end of said playing board; and a hinge connecting said first and second planar pieces together.

19. The game apparatus as defined in claim 18 wherein each of said first gain indicating bands is positioned adjacent at least one of said first loss indicating bands and is spaced from said other first gain indicating bands, each of said second gain indicating bands is positioned adjacent at least one of said second loss indicating bands and is spaced from said other second gain indicating bands, each of said first loss indicating bands is positioned adjacent at least one of said first gain indicating bands and is spaced from said other first loss indicating bands, and each of said second loss indicating bands is positioned adjacent at least one of said second gain indicating bands and is spaced from said other second loss indicating bands.

* * * * *